United States Patent [19]

Shennan et al.

[11] 4,436,798

[45] Mar. 13, 1984

[54] METHOD OF TREATING A DYE IMAGE

[75] Inventors: Christopher D. Shennan, Brentwood; Michael W. Fry, Ilford, both of England

[73] Assignee: Ciba-Geigy AG, Basel, Switzerland

[21] Appl. No.: 392,442

[22] Filed: Jun. 28, 1982

[30] Foreign Application Priority Data

Aug. 13, 1981 [GB] United Kingdom ..... 8124741

[51] Int. Cl.[3] ..... G03C 3/00; G03C 5/24

[52] U.S. Cl. ..... 430/17; 430/402; 430/565; 430/427; 430/430

[58] Field of Search ..... 430/372, 402, 551, 565, 430/17, 427, 430

[56] References Cited

U.S. PATENT DOCUMENTS

| | | | |
|---|---|---|---|
| 2,788,274 | 4/1957 | Ranger | 430/372 |
| 3,335,004 | 8/1967 | Wrisley et al. | 430/372 |
| 3,582,347 | 6/1971 | Holly et al. | 430/505 |
| 3,762,922 | 10/1973 | Lugosy et al. | 430/372 |
| 4,126,461 | 11/1978 | Pupo et al. | 430/402 |
| 4,200,466 | 4/1980 | Fujiwhara et al. | 430/566 |
| 4,343,886 | 8/1982 | Nakamura et al. | 430/551 |

FOREIGN PATENT DOCUMENTS

| | | |
|---|---|---|
| 1473873 | 5/1977 | United Kingdom . |
| 1564349 | 4/1980 | United Kingdom . |
| 2052772 | 1/1981 | United Kingdom . |

OTHER PUBLICATIONS

Handbook of Chemistry and Physics, 48th Ed., The Chemical Rubber Co., Cleveland, Ohio, 1967.

*Primary Examiner*—J. Travis Brown

*Attorney, Agent, or Firm*—Joseph G. Kolodny

[57] ABSTRACT

Method of treating a dye image in photographic material which dye image has been formed by the color coupling reaction of a primary aromatic amine color developing agent with a phenolic color coupler of the formula where T is hydroxy or amino, one of $R_1$ and $R_3$ is the coupling position and if it is the coupling position the substituent group is hydrogen or halogen, a nitrogen-linked heterocycle or a mercapto group, the other of $R_1$ and $R_3$ and $R_2$ and $R_4$ are each hydrogen or halogen or optionally substituted organic groups, or one or $R_1$ and $R_2$ together or $R_2$ and $R_3$ together may represent the atoms necessary to complete a benzannelated ring, which treatment method comprises treating the dye image with an aqueous solution which comprises a salt of a transition (b-sub group) metal, the concentration of the metal ion in the aqueous solution being at least $10^{-4}$ M.

With this method the spectral absorption range of dye images formed by the above phenolic or naphtholic coupler compounds can be increased or altered. Further the resistance of these dye images to fading by actinic light can be increased over a long period.

15 Claims, 5 Drawing Figures

D

METHOD OF TREATING A DYE IMAGE

METHOD OF TREATING A DYE IMAGE

Figure 1A:
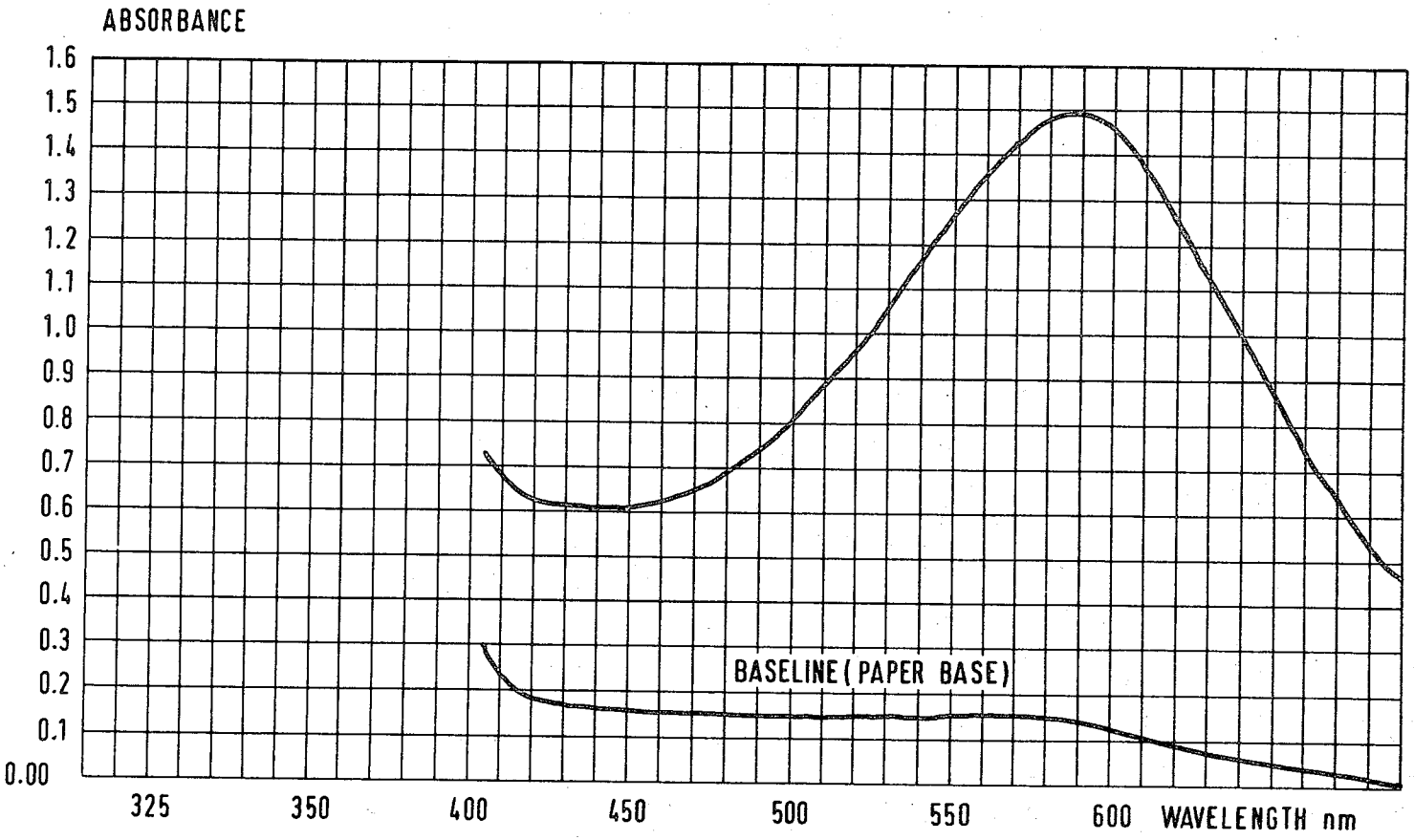

This invention relates to the use of phenolic or naphtholic compounds as colour couplers in photographic silver halide materials.

It has long been known that some phenolic and naphtholic compounds in particular resorcinols, can be used as photographic colour couplers to yield neutral density or blackish images. However in the past the need to produce black images was not very great and little if any use was made of such phenolic or naphtholic colour couplers. Now, however, because of the very high cost of silver a great need has arisen to either replace silver as the image in silver halide sensitized photographic materials or to reinforce silver images by use of black dyes. Thus the prior art phenolic and naphtholic compounds have been re-examined but none of them has been found to yield black images of sufficiently good colour or density. Furthermore great interest recently has been arisen in the so-called monochrome film material in which a dye image is used as the negative image from which to produce positive prints. Various hues of dye image have been tried out and there is a need to provide a wide range of hues for such dye images for various specialist printing purposes.

We have now found a method of either increasing the spectral absorption range of dye images formed from a class of phenolic or naphtholic compounds or of altering the spectral absorption of such dye images, or of increasing the resistance of dye images to fading by actinic light over a long period.

According to the present invention there is provided a method of treating a dye image in photographic material which dye image has been formed by the colour coupling reaction of a primary aromatic amine colour developing agent with a phenolic or naphtholic colour coupler of the formula

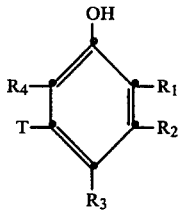

(1)

where T is —OH, —$NH_2$ or —$NHR_5$ where $R_5$ is alkyl or aryl, one of $R_1$ and $R_3$ is the coupling position and if it is the coupling position the substituent group is hydrogen or halogen, a nitrogen-linked heterocycle or —$SR_6$ where $R_6$ is optionally substituted alkyl having from 1 to 20 carbon atoms or optionally substituted aryl or an optionally substituted heterocycle, the other of $R_1$ and $R_3$ and $R_2$ and $R_4$ are each hydrogen or halogen or optionally substituted organic groups, or one of $R_1$ and $R_2$ together or $R_2$ and $R_3$ together may represent the atoms necessary to complete an optionally substituted benzannelated ring, which treatment method comprises treating the dye image with an aqueous solution which comprises a salt of a transition (b-sub group) metal or a metal of the third or fourth main group of the periodic table of the elements, the concentration of the metal ion in the aqueous solution being at least $10^{-4}$ M.

The organic groups $R_1$ to $R_4$ in the compounds of the formula (1) are those listed as substituents Y, W, X, X', W', Y' and Z' in the compounds of the formulae (2) and (4) (as shown hereinafter). Suitable alkyl, aryl, halogen and heterocyclic groups referred to in the definitions of the substituents of the phenolic or naphtholic colour couplers of the formula (1) are described in the explanation of the substituents of the compounds of the formulae (2) and (4).

An example of a useful class of phenolic coupler of formula (1) are the resorcinol couplers of formula

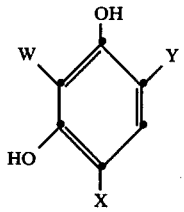

(2)

wherein

W is hydrogen, n-alkyl having from 1 to 5 carbon atoms, —$NHCOR^1$, or —$COR^1$ wherein $R^1$ is alkyl having 1 to 12 carbon atoms or alkenyl having 2 to 12 carbon atoms, cycloalkyl having 3 to 8 carbon atoms, aryl having 7 to 13 carbon atoms optionally substituted by one or two alkyl groups each having 1 to 4 carbon atoms, or halogen;

X is a substituent in the coupling position and is a leaving group selected from hydrogen, chlorine, bromine, a group of formula —$SR^{11}$ wherein $R^{11}$ is alkyl having 1 to 20 carbon atoms, aryl having 6 to 10 carbon atoms optionally substituted by one or two alkyl groups each having 1 to 4 carbon atoms, or a heterocyclic group, or X is a nitrogen-containing heterocyclic residue attached at a ring nitrogen atom;

Y independently is hydrogen or a group having the formula

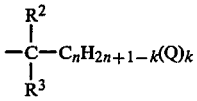

(2a)

wherein Q is selected from the residues:

(a) —$COOR^4$ or —$CONR^4R^5$ wherein $R^4$ is hydrogen, alkyl having 1 to 20 carbon atoms, optionally interrupted by 1 or more oxygen atoms, alkenyl having 3 to 20 carbon atoms, cycloalkyl having 3 to 12 carbon atoms, aralkyl having 7 to 13 carbon atoms or optionally substituted aryl having 6 to 10 carbon atoms and $R^5$ is hydrogen or alkyl having 1 to 20 carbon atoms, or $R^4$ and $R^5$, together with the nitrogen atom to which they are each bonded, may form a 5- or 6-membered heterocyclic ring optionally substituted by alkyl having 1 to 4 carbon atoms, preferably a pyrrolidine, piperidine or morpholine ring;

(b) —OM wherein M is $R^5$ or —$COR^6$ wherein $R^5$ is as defined above and $R^6$ is hydrogen, alkyl having 1 to 20 carbon atoms, alkenyl having 3 to 20 carbon atoms, cycloalkyl having 3 to 12 carbon atoms, aralkyl having 7 to 13 carbon atoms or optionally substituted aryl having 6 to 10 carbon atoms;

(c) —$NR^7R^8$ wherein $R^7$ is hydrogen or alkyl having 1 to 4 carbon atoms and $R^8$ is hydrogen, alkyl having 1 to 4 carbon atoms or acyl of the formula —$COR^4$ wherein $R^4$ is as defined above or $R^7$ and $R^8$, together with the nitrogen atom to which they are each bonded, form a 5- or 6-membered heterocyclic ring optionally substituted by alkyl having 1 to 4 carbon atoms, preferably a pyrrolidine, piperidine, morpholine or 3,5-dimethylmorpholine ring;

(d) —P(O) $(OR^9)(O)_xR^{10}$ wherein x is 0 or 1, $R^9$ is hydrogen or alkyl having 1 to 20 carbon atoms, $R^{10}$ is hydrogen or alkyl having 1 to 20 carbon atoms if x is 1, and $R^{10}$ is alkyl having 1 to 5 carbon atoms if x is 0, or $R^9$ and $R^{10}$ may be linked together to form an alkylene chain having 2 or 3 carbon atoms optionally substituted by one or more alkyl groups each having 1 to 20 carbon atoms;

(e) —$SO_2T$ wherein T is —OH or —$NR^4R^5$ wherein $R^4$ and $R^5$ are as defined above or (f) —CN;

n is an integer from 1 to 20; k is 1 or 2; $R^2$ and $R^3$ independently are alkyl having 1 to 5 carbon atoms, and, when Q is —$CO_2R^4$, either $R^2$ or $R^3$ is optionally substituted by one or two —$CO_2R^4$ groups, or at least one of $R_2$ and $R_3$ is so linked to the residue —$C_nH_{2n+1-k}$ that there is formed a cycloalkylene residue having 5 to 12 carbon atoms substituted by —$(CO_2R^4)_k$ in which the groups $R^4$ are the same or different and wherein $R^4$ and k are as defined above; or salts thereof with acids or bases.

The substituents W in the compounds of the formula (2) is hydrogen or alkyl. Preferred alkyl radicals are n-alkyl radicals and preferably those having 1 to 5 carbon atoms such as methyl, ethyl, propyl, butyl or pentyl. W denotes further acylamino of the formula —NH-$COR^1$ wherein $R^1$ is alkyl having 1 to 12 carbon atoms such methyl, ethyl, propyl, butyl, pentyl, hexyl, heptyl, octyl, nonyl, decyl and dodecyl as well as isomers thereof. Preferred are those alkyl radicals $R^1$ containing 1 to 6 carbon atoms. $R^1$ further denotes alkenyl. These radicals are derivable from the corresponding alkyl groups listed for $R^1$. Preferred alkenyl radicals are those having 2 to 16 carbon atoms such as vinyl, prop-1-enyl, 1-methylvinyl, but-1-enyl, hexa-2,4-dienyl, undec-10-enyl and dodec-1-enyl. $R^1$ denotes further cycloalkyl. Suitable cycloalkyl radicals contain 3 to 8 carbon atoms such as cyclopropyl, cyclopentyl, cyclohexyl and cyclooctyl. Preferred is cyclohexyl. $R^1$ denotes further aralkyl. Preferred aralkyl radicals contain 7 to 13 carbon atoms such as benzyl, phenethyl, benzhydryl, and naphthylmethyl. Benzyl is mostly preferred. In the meaning of aryl, $R^1$ represents a ring system having 6 to 10 carbon atoms such as phenyl and naphthyl. These aryl rings as well as the aryl nucleus of the said aralkyl radicals $R^1$ are optionally substituted by one or two alkyl groups. Preferably, these alkyl substituents contain 1 to 4 carbon atoms. Methyl and ethyl are mostly preferred. W denotes further acyl. Preferred acyl groups have the formula —$COR^1$ wherein $R^1$ has exactly the same meaning as in the group —$NHCOR^1$. —$COCH_3$ and —$COC_6H_5$ are especially preferred. Further, W is a phenoxymethylamino group which is optionally substituted with one or more alkyl groups. Preferably these alkyl groups contain 1 to 10 carbon atoms. Mostly preferred are methyl, t-butyl, t-pentyl and t-octyl. Preferably, 1 or 2 of these alkyl groups are substituents on the phenyl ring of the phenoxymethylamino group. W denotes further halogen. Suitable halogen radicals are fluorine and especially chlorine and bromine.

X is hydrogen, halogen such as chlorine and bromine or a mercapto group of the formula —$SR^{11}$. $R^{11}$ is alkyl preferably having 1 to 20 carbon atoms. In addition to those alkyl radicals listed above for $R^1$, preferably the radicals tetradecyl, pentadecyl, hexadecyl, octadecyl, ercosyl and their isomers are operable as $R^{11}$ in the group —$SR^{11}$. $R^{11}$ is further aryl, preferably having 6 to 10 carbon atoms such as phenyl and naphthyl which rings are optionally substituted by 1 or 2 alkyl groups (each) having 1 to 4 carbon atoms. In the meaning of a heterocyclic group, $R^{11}$ denotes preferably a 3–7 membered ring, containing one or more oxygen, nitrogen or sulphur atoms it may be for example, oxirane, azetidine, furan, thiophene, pyrrole, oxazole, isoxazole, thiazole, isothiazole, pyrazole, imidazole, triazole, oxadiazole, thiadiazole, thiatriazole, tetrazole, pyridine, pyrimidine, pyrazine, pyridazine, triazine or azepine. X is further a nitrogen-containing heterocyclic residue attached at the resorcinol nucleus by a ring nitrogen atom. Preferred heterocyclic rings X are 5 to 7 membered rings containing one or more nitrogen atoms, and optionally an oxygen or sulphur atom, it may be, for example, pyrrolidindione or piperidin-dione.

Y is a group of the formula

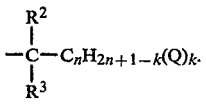

In these radicals Q denotes a group of the formula —$COOR^4$ or —$CONR^4R^5$.

$R^4$ is hydrogen or alkyl, preferably containing 1 to 20 carbon atoms. Suitable alkyl radicals $R^4$ are those listed in the definitions of $R^1$ and $R^{11}$. Preferred are the alkyl radicals having 1 to 12 carbon atoms. The alkyl groups $R^4$ are optionally interrupted by 1 or more, particularyl 2 oxygen atoms. Further, $R^4$ is alkenyl having 3 to 20 carbon atoms. Suitable alkenyl radicals are those listed above for $R^1$. Preferred are for example, prop-2-enyl, but-2-enyl, 3-methyl-but-2-enyl, octadec-9-enyl and eicos-2-enyl. $R^4$ denotes further cycloalkyl, preferably containing 3 to 12 carbon atoms such as cyclopropyl, cyclobutyl, cyclopentyl, cyclohexyl, cyclooctyl and cyclodecyl, cyclododecyl as well as cycloalkyl systems which are bi- or tri-cyclic such as adamantyl e.g. $R^4$ denotes further aralkyl. Preferred aralkyl radicals contain 7 to 13 carbon atoms such as benzyl, phenethyl, benzhydryl, and naphthylmethyl. Preferred aryl groups $R^4$ contain 6 to 10 carbon atoms are e.g. phenyl and naphthyl which are optionally substituted by one or two alkyl groups each having 1 to 4 carbon atoms, or by one or two —$CF_3$, —CN, —$CONH_2$, —$COOCH_3$, —$NO_2$, —$OCH_3$ or halogen groups. $R^5$ is hydrogen or alkyl preferably having 1 to 20 carbon atoms, more preferably 1 to 10 and most preferably 5 to 10 carbon atoms. $R^4$ and $R^5$, together with the nitrogen atom to which they are bonded, form a heterocyclic ring. Preferred are 5- or 6- membered heterocyclic rings such as morpholinyl or piperidinyl radicals which are optionally substituted by alkyl, preferably containing 1 to 4 carbon atoms.

Further, Q denotes a radical of the formula —OM, wherein M is $R_5$ as just defined above or an acyl group such as —$COR^6$. $R^6$ is hydrogen or alkyl having 1 to 20 carbon atoms. Suitable alkyl radicals are those listed above in the definition of $R^{11}$. Preferably, these alkyl radicals contain 1 to 10 or, more preferably, 1 to 5 carbon atoms. $R^6$ is further alkenyl, preferably having 3 to 20 carbon atoms. Suitable alkenyl radicals which preferably contain 3 to 10 carbon atoms are derivable from the alkyl radicals $R^6$. Further, $R^6$ denotes cycloalkyl preferably containing 3 to 12 carbon atoms. Suitable radicals are listed above for $R^4$. In the meaning of aralkyl, $R^6$ contains preferably 7 to 13 carbon atoms and is e.g. benzyl, phenethyl, benzhydryl, and naphthylmethyl. $R^6$ denotes further aryl, preferably containing 6 to 10 carbon atoms such as phenyl or naphthyl, e.g., which aryl radicals are optionally substituted by alkyl having 1 to 10, preferably 5 to 10 carbon atoms. Most preferably, these alkyl radicals are branched radicals.

Further, Q denotes an amino group. Suitable amino groups correspond to the formula $—NR^7R^8$. $R^7$ in this formula is hydrogen or alkyl such as methyl, ethyl, propyl, 1-propyl(and)butyl. $R^8$ is hydrogen, further alkyl such as methyl, ethyl, propyl, i-propyl and butyl, and further an acyl group of the formula $—COR^4$ wherein $R^4$ is as defined above. $R^7$ and $R^8$ form together with the nitrogen atom to which they are bonded a heterocyclic ring. Preferably, this ring is 5- or 6-membered and is e.g. a pyrrolidinyl, piperidinyl or morpholino ring. These heterocyclic rings are optionally substituted by alkyl having 1 to 4 carbon atoms.

Q denotes further a group of the formula $—P(O)(OR^9)(O)_xR^{10}$. $R^9$ is hydrogen or alkyl having 1 to 20 carbon atoms. Suitable alkyl groups are listed above in the definition of $R^6$. Preferred alkyl groups contain 1 to 10 or, more preferably, 1 to 5 carbon atoms. The index x is 0 or 1. $R^{10}$ has the same meaning as $R^9$ if x is 1; and $R^{10}$ is alkyl containing 1 to 5 carbon atoms such as methyl, ethyl, propyl, i-propyl, butyl, pentyl or i-pentyl if x is 0.

$R^9$ and $R^{10}$ are further linked together to form an alkylene chain. Preferably, this alkylene chain contains 2 or 3 carbon atoms which are optionally substituted by one or more, preferably one or two, alkyl groups each having 1 to 20 carbon atoms. Suitable alkyl groups are listed above in the definition of $R^6$.

Q further denotes a group of the formula $—SO_2T$, where T is hydroxy or an amino group of the formula $—NR^4R^5$. $R^4$ and $R^5$ are as defined above. Preferably $R^4$ and $R^5$ have the same meaning and an alkyl having 1 to 5 carbon atoms such as methyl, ethyl, propyl, i-propyl, butyl, pentyl or i-pentyl.

Q further denotes cyano.

n is an integer from 1 to 20 or, preferably from 1 to 10; k is 1 or 2.

$R^2$ and $R^3$ independently are alkyl preferably having 1 to 5 carbon atoms such as methyl, ethyl, n-propyl, iso-propyl, n-butyl, s-butyl, n-pentyl, or neopentyl. If Q denotes $—CO_2R^4$, either $R^2$ or $R^3$ is optionally substituted by one or two $—CO_2R^4$ groups or at least one of $R^2$ and $R^3$ is so linked to the residue $—C_nH_{2n+1-k}$ that there is formed a cycloalkylene residue preferably containing 5 to 12 carbon atoms, more preferably a cyclohexylene ring, substituted by $—(CO_2R^4)_k$ wherein $R^4$ are the same or different and wherein $R^4$ and k are as defined above. When the groups $R^9$ and $R^{10}$ are linked to form said methylene chain optionally substituted by one or more alkyl groups having 1 to 20 carbon atoms they may be for example $—CH_2CH_2—$, $—CH_2CH_2CH_2—$, $—CH_2CH(CH_3)—$, $—CH_2CH(C_2H_5)—$, $—CH_2CH(C_{20}H_{41})—$, $—CH(CH_3)CH(CH_3)—$, $—CH(CH_3)C(CH_3)_2—$, $—C(CH_3)_2C(CF_3)_2—$, $—CH_2CH_2C(CH_3)_2—$, or $—CH(CH_3)CH_2CH(CH_3)—$.

Examples of salts of the compounds of the formula (2) are those formed from the alkali metals, the alkaline earth metals, transition element cations and ammonium and substituted ammonium cations. Examples of salts of the compounds of the formula (2) which contain a residue Q wherein Q is $—NR^7R^8$ are the hydrochloride, sulphate, p-toluene sulphonate, maleate and oxalate salts.

Preferably, the material contains a resorcinol compound of the formula (2) wherein W is hydrogen, n-alkyl having 1 to 5 carbon atoms, cyclopentyl, cyclohexyl, phenyl optionally substituted by one or two alkyl groups each having 1 to 4 carbon atoms or W is halogen, X is hydrogen, chlorine, bromine, $—SR^{11}$ where $R^{11}$ is alkyl having 1 to 10 carbon atoms, phenyl optionally substituted by one or two alkyl groups each having 1 to 4 carbon atoms or a tetrazolyl ring optionally substituted by alkyl having 1 to 4 carbon atoms or phenyl, Y is a group of the formula

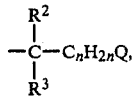

where Q is $—COOR^4$ or $—CONR^4R^5$ where $R^4$ is hydrogen, alkyl having 1 to 12 carbon atoms optionally interrupted by 1 or 2 oxygen atoms, benzyl or phenyl and $R^5$ is hydrogen or alkyl having 1 to 10 carbon atoms, or $R^4$ and $R^5$, together with the nitrogen atom to which they are bonded form a morpholinyl or a piperidinyl radical, or Q is —OM, where M is hydrogen or alkyl having 1 to 5 carbon atoms, or M is $—COR^6$ where $R^6$ is hydrogen, alkyl having 1 to 10 carbon atoms, cyclohexyl, phenyl or benzyl, or Q is $—NR^7R^8$ where $R^7$ is hydrogen or alkyl having 1 to 4 carbon atoms and $R^8$ is $—COR_4$ where $R_4$ is as defined above, or Q is $—P(O)(OR^9)_2$ where $R^9$ is alkyl having 1 to 10 carbon atoms, or Q is $—SO_2T$ where T is hydroxy or $—NR^4R^5$ where $R^4$ $R^5$ are as defined above, $R^2$ and $R^3$ are alkyl having 1 to 5 carbon atoms or at least one of $R^2$ and $R^3$ is so linked to the residue $—C_nH_{2n}—$ that there is formed a cycloalkyl group having 5 to 8 carbon atoms optionally substituted by a group $—COOR^4$ where $R^4$ is as defined above, and n is an integer from 1 to 20.

Further preferred material contains a resorcinol compound of the formula (2) wherein W is hydrogen, methyl, chlorine or bromine, X is hydrogen, chlorine, bromine or a group of the formula

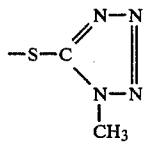

and Y is a group of the formula

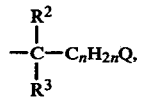

wherein

Q is —COOR$^4$ or —CONR$^4$R$^5$, where R$^4$ is hydrogen or alkyl having 1 to 12 carbon atoms and R$^5$ is alkyl having 5 to 10 carbon atoms or phenyl optionally substituted by alkyl having 1 to 4 carbon atoms, or Q is —OM, wher M is hydrogen or —COR$_6$ where R$_6$ is alkyl having 1 to 5 carbon atoms, or Q is —NHR$_8$ where R$_8$ is —COR$_6$ where R$_6$ is as just defined or Q is —P(O)(OR$_9$)$_2$, where R$_9$ is alkyl having 1 to 5 carbon atoms, or Q is —SO$_2$NR$^5$R$^6$ where R$^6$ is as defined above, and R$_2$ and R$_3$ are alkyl having 1 to 5 carbon atoms or R$_2$ forms together with the residue —C$_n$H$_{2n}$— a cyclohexyl group substituted by —COOR$^4$ where R$^4$ is as defined above, and n is an integer from 1 to 10.

Especially preferred are those compounds of the formula (2) wherein R$^2$ is methyl. In further suitable compounds of the formula (2) substituent W is hydrogen, methyl, ethyl, butyl, —NHCOR$^1$ wherein R$^1$ is alkyl having 1 to 6 carbon atoms or alkenyl having 2 to 6 carbon atoms, cyclohexyl, benzyl, phenyl, optionally substituted by one or two methyl or ethyl groups, or W is chlorine or bromine. Preferably, W is hydrogen, methyl, —NHCOCH$_2$C$_6$H$_5$, a phenoxymethylamino group optionally substituted with one or more alkyl groups, chlorine or bromine.

Preferably, in compounds of the formula (2), n is 1 to 10, k is 1, R$^3$ R$^3$ is alkyl having 1 to 5 carbon atoms, Q is —CO$_2$R$^4$ or CONR$^4$R$^5$, —NR$^7$R$^8$ or —OM wherein R$^4$, R$^5$, R$^7$, R$^8$ and M are as defined above and W is hydrogen, methyl, —NHCOCH$_2$C$_6$H$_5$, —NHCOC$_6$H$_5$ or a phenoxymethylamino group optionally substituted with one or more alkyl groups, chlorine or bromine.

Preferred compounds of the formula (2) are those wherein n is 3 to 5, k is 1, R$^3$ is methyl, Q is —CO$_2$R$^4$ or —CONR$^4$R$^5$ or —NR$^7$R$^5$ wherein R$^4$, R$^5$, R$^7$ and R$^8$ are as defined above, and W is hydrogen methyl, —NHCOCH$_2$C$_6$H$_5$, —NHCOC$_6$H$_5$ or a phenoxymethylamino group optionally substituted with one or more alkyl groups.

The compounds of formula (2) may be prepared by reacting in the presence of an acid or Friedel-Crafts catalyst, in the temperature range 20° to 150° C., a compound of the formula

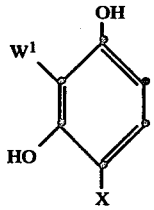

(3)

wherein X is as defined above, W$^1$ is hydrogen, n-alkyl having from 1–5 carbon atoms, —NH$_2$, —NHCOR$^1$ or —COR$^1$ wherein R$^1$ is as defined above, —NO$_2$ or halogen with a functional alkylating agent capable of introducing a group of the formula (2a) above, optionally reducing any nitro group W$^1$ to an amino group, and then acylating this amino group to form a group —NHCOR$^1$ wherein R$^1$ is as defined above; and optionally introducing into the 2- or 6-position, substituents W and/or X which are respectively other than hydrogen.

The reactants of formula (3) are well-known and can be produced by methods well known per se.

Another example of a useful class of phenolic couplers of the formula (1) are the resorcinol couplers of the formula

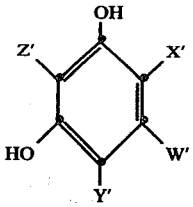

(4)

where each of W', Y' and Z' is hydrogen, chlorine or bromine, a nitrogen-linked heterocycle, —SR$_1$' where R$_1$' is optionally substituted alkyl having 1 to 20 carbon atoms, optionally substituted aryl or an optionally substituted heterocycle, or W', Y' or Z' is —NHCOR$_2$' where R$_2$' is alkyl or —R$_3$' where R$_3$' is optionally substituted primary or secondary alkyl having 1 to 20 carbon atoms of the formula

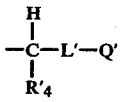

where L' is an alkylene linking group —(C$_m$H$_{2m}$)— where m is 1 to 20, or a chemical bond, R$_4$' is hydrogen or alkyl having 1 to 20 carbon atoms, or R$_4$' together with L' form a saturated 5- or 6-membered carbocyclic ring linking group, and Q' is hydrogen or is a group selected from —OCOR$_5$' where R$_5$' is alkyl having 1 to 20 carbon atoms, —CO$_2$R$_5$' where R$_5$' is as just defined, —CONHR$_6$' where R$_6$' is alkyl having 1 to 20 carbon atoms or is optionally substituted aryl, —OR$_6$' where R$_6$' is as just defined, —NHCOR$_7$' where R$_7$' is alkyl having 1 to 20 carbon atoms or is optionally substituted aryl, —SO$_3$M' where M' is hydrogen or a cation, —P(O)(OR$_8$')$_2$ where R$_8$' is alkyl having 1 to 20 carbon atoms or —NR$_9$'R$_{10}$' where each of R$_9$' and R$_{10}$' are hydrogen or optionally substituted alkyl or aryl, or R$_3$' is unsubstituted tertiary alkyl wherein the tertiary atom is adjacent to the benzene ring or a secondary or tertiary cycloalkyl having 3 to 20 carbon atoms or R$_3$' is aralkyl having 7 to 20 carbon atoms or Z' alone is —CO—R$_1$' where R$_1$' is as just defined but at least one of W', Y' and Z' must be —R$_3$', and X' which is the coupling position is hydrogen, chlorine or bromine, a nitrogen-linked heterocycle or the group —SR$_1$.

The substituents W', Y' and Z' in the compounds of formula (5) are hydrogen or halogen such as fluorine, chlorine or bromine, preferably chlorine or bromine.

Further, W', Y' and Z' denote a heterocyclic ring. Preferably, this heterocyclic ring contains 5 to 6 ring atoms, at least one of which is a nitrogen atom which provides the linkage of the heterocycle to the resorcinol nucleus. Most preferably, the heterocycle has the formula

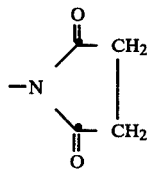

wherein the hydrogen atoms are optionally replaced by substituents such as alkyl, preferably having 1 to 4 carbon atoms, or aryl, preferably phenyl, which substituents are optionally further substituted.

W', Y' and Z' denote further a mercapto group of the formula $—SR_1'$, $R_1'$ in this formula is alkyl having preferably 1 to 20 carbon atoms such as methyl, ethyl, propyl, i-propyl, n-pentyl, 1,1-dimethylpropyl, 1,1,3,3-tetramethylbutyl,hexyl, 1-methylpentyl, neopentyl, 1-, 2- or 3-methylhexyl, heptyl, n-octyl, t-octyl, 2-ethylhexyl, n-nonyl, i-nonyl and decyl. Further, undecyl, dodecyl, tetradecyl, octadecyl and eicosyl as well as isomers thereof. These alkyl groups are optionally further substituted by, e.g., alkoxy having 1 to 10, preferably 1 to 4 carbon atoms, carbalkoxy having preferably 2 to 5 carbon atoms, phenyl or halogen. Preferred substituents for the alkyl groups are methoxy, ethoxy, propoxy, butoxy, groups of the formulae $—COOCH_3$, $—COOC_2H_5$, $—COOC_4H_9$, $—COOC_8H_{17}$, $—COOC_{12}H_{25}$, phenyl and chlorine or bromine. Preferably the alkyl groups $R_1'$ contain 1 to 10, especially 5 to 10 carbon atoms. Further, $R_1'$ denotes aryl which is optionally substituted. Preferred aryl groups are e.g. phenyl and naphthyl and suitable substituents for these aryl rings are e.g. the above mentioned alkoxy, carbalkoxy and halogen radicals. $R_1'$ has further the meaning of a heterocyclic ring which is optionally substituted. This heterocycle preferably represents a nitrogen containing ring having 6, or preferably 5 ring atoms such as radicals of the formula

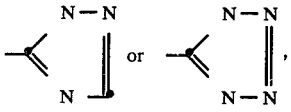

wherein the nitrogen atom adjacent to the carbon atom which provides the linkage to the resorcinol nucleus is optionally further substituted. Preferred substituents are e.g. alkyl having 1 to 4 carbon atoms, preferably methyl, or especially phenyl.

W', Y' and Z' are further acylamino, preferably of the formula $—NHCOR_2'$, wherein $R_2'$ is alkyl or aryl. Suitable alkyl groups and the substituents for these groups are listed above in the definitions of $R_1'$. Alkyl radicals $R_2'$ containing 1 to 10 carbon atoms, and especially methyl are mostly preferred. A suitable aryl group is phenyl. W', Y' or Z' further denotes a radical $R_3'$ where $R_3'$ is an optionally substituted primary or secondary alkyl group having 1 to 20, preferably 1 to 15 carbon atoms, which groups preferably are derivable from the formula

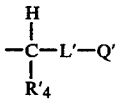

where L' is an alkylene linking group of the formula $—(C_mH_{2m})—$, m being an integer of from 0 to 20, preferably from 0 to 15. The alkylene chain may be straight or branched.

$R_4'$ is the above formula denotes hydrogen or alkyl, preferably containing 1 to 20 carbon atoms, more preferably 1 to 10, especially 1 to 5 carbon atoms. Suitable alkyl radicals are listed above in the definitions of $R_1'$. Further, $R_4'$ together with L form a carbocyclic ring, preferably 5- or 6-membered and saturated, such as cyclopentyl or cyclohexyl, which rings are optionally further substituted by phenyl or methyl, ethyl, n-propyl, i-propyl, n-butyl or t-butyl groups. Q' in the above formula denotes hydrogen or one of the following substituents: acyloxy or carbalkoxy of the formulae $—CO_2R_5'$ and $—OCOR_5'$, wherein $R_5'$ is alkyl, preferably containing 1 to 20, especially 1 to 15 and most preferably 6 to 12 carbon atoms—for suitable radicals c.f. above the definitions of $R_1'$—; alkoxy or carbonamido or acylamino of the formulae $—OR_6'$, $—CONHR_6'$ and $—NHCOR_6'$, wherein $R_6'$ is alkyl preferably having 1 to 20, or 1 to 10 or most preferably 1 to 5 carbonatoms or aryl such as phenyl—for suitable alkyl and aryl radicals c.f. above the definitions of $R_1'$—; a sulpho group of the formula $—SO_3M'$, wherein M' is hydrogen or a cation such as ammonium or preferably an alkali metal; a phosphoric acid ester group of the formula $—P(O)(OR_5')_2$, where $R_5'$ is as defined above; and an amino group of the formula $—NR_7'R_8'$, where $R_7'$ and $R_8'$ are hydrogen or optionally substituted alkyl preferably having 1 to 5 carbon atoms or aryl groups—for suitable alkyl and aryl groups c.f. above the definitions of $R_1'$—. Preferably, $R_7'$ and $R_8'$ are each hydrogen $R_3'$ is further alkyl which is preferably an unsubstituted and tertiary alkyl group. The tertiary carbon atom of the alkyl group is adjacent to the benzene ring. The alkyl groups contain preferably 3 to 20 or, more preferably, 3 to 10 or 5 to 10 carbon atoms. Such radicals are listed above in the definitions of $R_1'$. Further $R_3'$ is a secondary or tertiary cycloalkyl group, preferably containing 3 to 20, especially 3 to 10 or, most preferably, 5 to 10 carbon atoms such as cyclopentyl, cyclohexyl or cyclooctyl having as a substituent an alkyl group, preferably with 1 to 4 carbon atoms. $R_3'$ is further aralkyl having from 7 to 20, preferably 7 to 15 carbon atoms. The aryl moieties, preferably phenyl radicals, may be further substituted by one or more alkyl radicals, each preferably having 1 to 4 carbon atoms.

Z' alone may denote a group of the formula $—COR_1'$, where $R_1'$ is as defined above. At least one of W', Y' and Z' must be $—R_3'$ which is as defined above.

X' denotes the coupling position and is hydrogen or halogen such as chlorine, bromine or iodine, preferably chlorine or bromine, further a nitrogen-linked heterocycle or the mercapto group $—SR_1'$. Such radicals are defined above in the definitions of W', Y' and Z'.

Suitable compounds of the formula (4) for use in the inventive method are those wherein each of W', Y' and Z' is hydrogen, chlorine or bromine, a nitrogen-linked heterocycle, $—SR_1'$ where $R_1'$ is optionally substituted alkyl having 1 to 20 carbon atoms, optionally substituted aryl or an optionally substituted heterocycle or W', Y' or Z' is —NHCOR$_2$', where R$_2$' is alkyl or —R$_3$' where R$_3$' where R$_3$' is optionally substituted primary or secondary alkyl having 1 to 20 carbon atoms of the formula

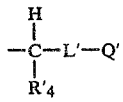

where L' is an alkylene linking group —($C_mH_{2m}$)— where m is 1 to 20, or a chemical bond, R$_4$' is hydrogen or alkyl having 1 to 20 carbon atoms, or R$_4$' together with L form a saturated 5- or 6-membered carbocyclic ring linking group, and Q' is hydrogen or is a group selected from —OCOR$_5$' where R$_5$' is alkyl having 1 to 20 carbon atoms,
—CO$_2$R$_5$' where R$_5$' is as just defined,
—CONHR$_6$' where R$_6$' is alkyl having 1 to 20 carbon atoms or is optionally substituted aryl,
—OR$_6$', where R$_6$' is as just defined,
—NHCOR$_6$' where R$_6$' is as defined above,
—SO$_3$M' where M' is hydrogen or a cation,
—P(O)(OR$_5$')$_2$ where R$_5$' is as defined above or
—NR'$_7$R$_8$' where each of R$_7$' and R$_8$' are hydrogen or optionally substituted alkyl or aryl, or R$_3$' is unsubstituted tertiary alkyl wherein the tertiary atom is adjacent to the benzene ring or a secondary or tertiary cycloalkyl having 3 to 20 carbon atoms or R$_3$' is aralkyl having 7 to 20 carbon atoms or Z alone is —CO—R$_1$' where R$_1$' is as just defined but at least one of W', Y' and Z' must be —R$_3$', and X which is the coupling position is hydrogen, chlorine or bromine, a nitrogen-linked heterocycle or —SR$_1$.

More suitable compounds of the formula (4) for use in the inventive method are those wherein W', Y' and Z' are hydrogen, chlorine, bromine, a radical of the formula

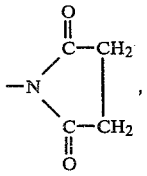

wherein the hydrogen atoms are optionally replaced by alkyl having 1 to 4 carbon atoms or phenyl, or W', Y' and Z' are —SR$_1$', wherein R$_1$' is alkyl having 1 to 20 carbon atoms, optionally substituted by alkoxy having 1 to 10 carbon atoms, carbalkoxy having 2 to 5 carbon atoms, phenyl or halogen, or R$_1$' is phenyl optionally substituted by alkoxy having 1 to 10 carbon atoms, carbalkoxy having 2 to 5 carbon atoms, phenyl or halogen, or R$_1$' is a radical of the formula

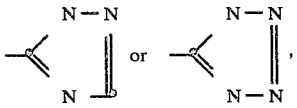

wherein the nitrogen atom adjacent to the carbon atom which provides the linkage to the resorcinol nucleus is optionally substituted by alkyl having 1 to 4 carbon atoms or phenyl, or W', Y' or Z' is a group —NHCOR$_2$', where R$_2$' is alkyl having 1 to 20 carbon atoms or phenyl, optionally substituted by alkoxy having 1 to 10 carbon atoms, carbalkoxy having 2 to 5 carbon atoms, phenyl or halogen or W,' Y' or Z' is a group —R$_3$' where —R$_3$' is primary or secondary alkyl having from 1 to 15 carbon atoms of the formula

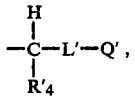

where L' is an alkylene linking group of the formula —($C_mH_{2m}$)—, m being an integer of from 1 to 15 or a chemical bond, R$_4$' is hydrogen, alkyl having 1 to 10 carbon atoms or forms together with L' a cyclopentyl or cyclohexyl ring which is optionally substituted by phenyl, methyl, ethyl, n-propyl, i-propyl, n-butyl or t-butyl, Q' is hydrogen or —CO$_2$R$_5$' or —OCOR$_5$' where R$_5$' is alkyl having 1 to 20 carbon atoms; —OR$_6$', —CONHR$_6$' or —NHCOR$_6$' where R$_6$' is alkyl having 1 to 10 carbon atoms or phenyl optionally substituted by alkyl groups each having 1 to 10 carbon atoms, —SO$_3$M' where M' is hydrogen, ammonium or an alkali metal; —P(O)(OR$_6$')$_2$, where R$_6$' is as defined above; or —NR$_7$'R$_8$' where R$_7$' and R$_8$' are hydrogen, alkyl having 1 to 5 carbon atoms or phenyl; or R$_3$' is unsubstituted tertiary alkyl having 3 to 10 carbon atoms or R$_3$' is secondary or tertiary cycloalkyl having 3 to 10 carbon atoms, or R$_3$ is aralkyl having 7 to 20 carbon atoms, or Z' alone is —COR$_1$' where R$_1$' is as defined above but at least one of W,' Y' and Z' must be —R$_3$', X' is hydrogen, chlorine, a radical of the formula

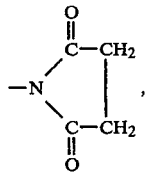

wherein the hydrogen atoms are optionally replaced by alkyl having 1 to 4 carbon atoms or phenyl, or X' is —SR$_1$' where R$_1$' is as defined above.

Preferably, the compounds of the formula (4) for use in the inventive method are those wherein W,' Y' and Z' are hydrogen, chlorine, bromine, a radical of the formula

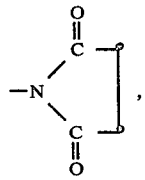

—SR$_1$' wherein R$_1$' is alkyl having 1 to 10 carbon atoms or phenyl or a radical of the formula

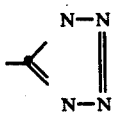

wherein the nitrogen atom adjacent to the carbon atom which provides the linkage to the resorcinol nucleus is optionally substituted by phenyl or methyl, or W,' Y' or Z' is —$NHCOR_2$' where $R_2$' is alkyl having 1 to 10 carbon atoms or phenyl or W,' Y' or Z' is a group —$R_3$' where —$R_3$' is primary or secondary alkyl having 1 to 15 carbon atoms of the formula

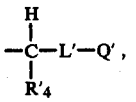

where L' is s defined in claim 6, $R_4$' is hydrogen, alkyl having 1 to 5 carbon atoms or forms together with L' a cyclopentyl or cyclohexyl ring optionally substituted by phenyl, methyl or t-butyl, Q' is hydrogen, —$CO_2R_5$' or —$OCOR_5$' where $R_5$' is alkyl having 6 to 12 carbon atoms; —$OR_6$', —$CONHR_6$' or —$NHCOR_6$' where $R_6$ is alkyl having 1 to 5 carbon atoms or phenyl; —$SO_3M$' where M' is hydrogen or an alkali metal; —P(O)-$(OR_6')_2$, where $R_6$' is as defined above; and —$NR_7'R_8'$ where $R_7$' and $R_8$' are hydrogen, alkyl having 1 to 5 carbon atoms or phenyl; $R_3$' is unsubstituted tertiary alkyl having 5 to 10 carbon atoms or secondary or tertiary cycloalkyl having 5 to 10 carbon atoms, or $R_3$' is aralkyl having 7 to 15 carbon atoms, or Z' alone is —$COR_1$' where $R_1$' is as defined above but at least one of W', Y' and Z' must be —$R_3$', X' is hydrogen, chlorine, bromine or —$SR_1$' where $R_1$' is as defined above.

Most preferably, the compounds of the formula (4) for use in the inventive method are those wherein W', Y' and Z' are hydrogen, chlorine, bromine, or W', Y' or Z' is —$NHCOR_2$' where $R_2$' is methyl, phenyl, or a group —$R_3$' where —$R_3$' is primary or secondary alkyl having 1 to 15 carbon atoms of the formula

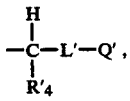

where L' is as defined in claim 7, $R_4$ is hydrogen methyl or forms together with L' a cyclohexyl ring optionally substituted by t-butyl, Q' is hydrogen, —$CO_2R_5$' where $R_5$' is alkyl having 5 to 15 carbon atoms, —$OR_6$' where $R_6$' is phenyl optionally substituted by alkyl groups each having 4 to 8 carbon atoms, or amino or —$NHCOCH_3$ or —$NHCOC_6H_5$; or $R_3$' is unsubstituted tertiary alkyl having 5 to 8 carbon atoms or $R_3$' is secondary or tertiary cycloalkyl having 5 to 10 carbon atoms or aralkyl having 7 to 15 carbon atoms, at least one of W', Y' and Z' must be —$R_3$', and Y' is hydrogen, chlorine bromine or a radical of the formula

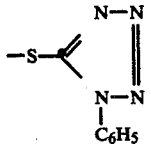

Preferably in the compounds of formula (4) X' and Z' are hydrogen.

In another preferred group of the compounds of formula (4), X', W' and Z' are all hydrogen and Y' is the primary or secondary alkyl group $R_3$' defined above or the unsubstituted tertiary alkyl group $R_3$' defined above.

The compounds of the formula (4) may be prepared in a similar manner as described for the compounds of the formula (2).

Methods of synthesis of the resorcinols of formulae (1), (2) and (4) are further well documented for example in C. J. Baylis, S. W. Odle and J. H. Tyman, J. C. S. Perkin 1, 1981, 132; R. S. Marmor J. Org. Chem, 1972, 37, 2901; Houben-Weyl, "Methoden der Organischen Chemie", Vol.6, Part 1c (Georg Thieme, Stuttgart, 1976); S. Coffey, Rodd's "Chemistry of Carbon Compounds", 2nd Edn., Vol 3, Part A (Elsevier, Amsterdam, 1971); E. Biller, W. R. Carmichael and C. Richter, CHEM. and Ind. Synthesis, 1973, 685; N. Schamp, R. Verke and L. De Buyck, Tetrahedron, 1973, 29, 3857; and B.P. 1579557. Any novel compounds covered by formulae (1), (2) and (4) may be produced by analogous methods.

Synthesis of nuclear-substituted resorcinols (e.g. by halogen, mercaptan) can also be achieved by well-known routes in, for example Rodd (see above).

Another useful class of phenolic couplers has the formula

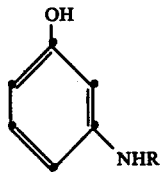

(5)

(described in GB 1,564,349) and the naphthoresorcinol couplers of the formula

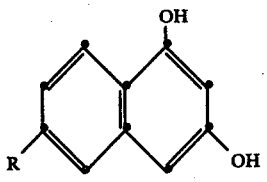

(6)

(described in GB 2,052,772A).

The periodic table referred to is given in the Handbook of Chemistry and Physics, 61th edition, 1980–1981, CRC Press, Inc.

The preferred metal salts for use in the method of the present invention are salts of manganese, iron, nickel, cobalt, copper, zinc, cadmium, lead, aluminium, vanadium, chromium and titanium. Vanadium and especially iron salts are particularly preferred.

Preferably the metals are present in a valency state having good air and water stability for example: iron (II) or (III), copper (II) and vanadium (IV) such as oxovanadium. Preferred anions are halides such as chloride and bromide and also sulphate.

Mostly preferred is ferrous sulphate.

Usefully the concentration of metal ion in the aqueous solution is M/50 but in some cases, for example in the case of iron (III), this higher concentration tends to produce a faint stain.

Preferably the aqueous solution which comprises the specified metal ion is a water wash bath or separate aqueous treatment bath which is employed between treatment steps in the processing of the photographic material.

Alternatively the specified metal ion may be present in a bleach-fix bath, a fix bath or a wash bath, all these baths being aqueous baths used in the processing of photographic material.

Suitable primary aromatic amine colour developing agents for use in preparing the dye image are p-phenylenediamine compounds for example 4-amino-N,N-dimethylaniline hydrochloride, 4-amino-N, N-diethylaniline hydrochloride, 4-amino-3-methyl-N, N-diethylaniline chloride and p-amino-phenol compounds for example a p-aminophenol itself and 2,6-dichloro-4-aminophenol.

The method of the present invention may be employed to alter the density hue of a dye image alone in photographic material, i.e. photographic material wherein the silver image has been removed by a bleach fix step. Alternatively the method of the present invention may be used to alter the density or hue of a dye reinforced silver image, i.e. photographic material from which the silver image has not been removed.

The following Examples will serve to illustrate the invention.

EXAMPLE I

Preparation of silver halide photographic material containing a coupler of formula (2).

10 g of the coupler of the formula

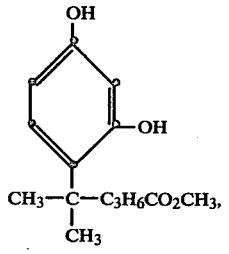

10 g diethyl lauramide and 10 g ethyl acetate are mixed, warmed and stirred till dissolved. This mixture is then added to a mixture of 80 g of 10% deionised gelatin(-containing 20 mg 4-chloro-3-methyl-phenol) 20 g 5% Nekal BX solution(alkyl naphthalene sulphonate) and 20 g distilled water.

The mixture obtained is emulsified using a 150w ultrasonic mixer to form a colour coupler dispersion. 0,043 mols of a silver chlorobromide emulsion containing 25% chloride (crystal medium size 0.35 pm) was added, together with surfactants for coating, and hardener, and the emulsion was coated on paper photographic base to give a silver coating weight of 10 mg/dm$^2$ and a coupler coating weight of 21,4 mg/dm$^2$ of mg/dm$^2$.

Figure 2B:
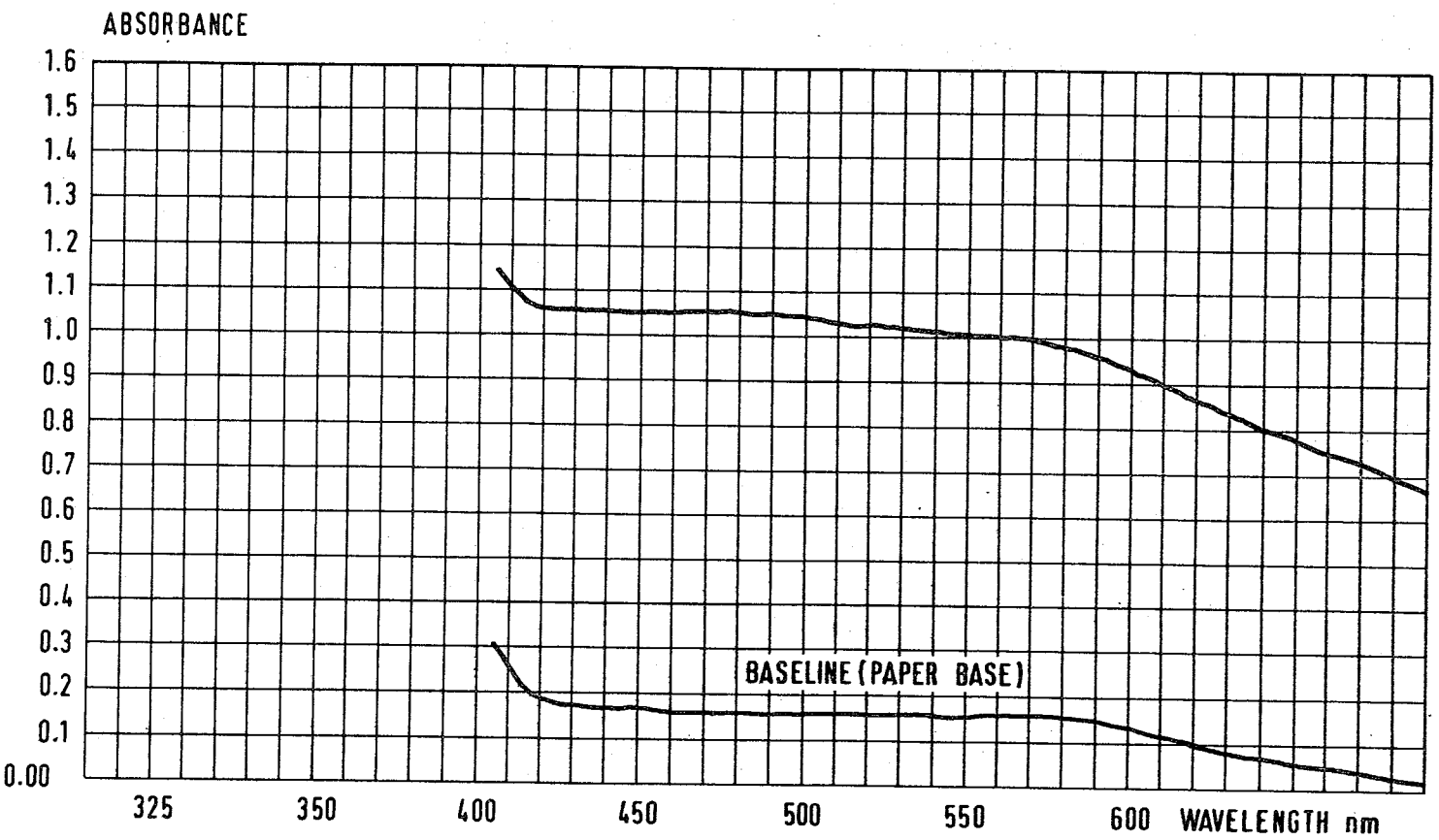

Exposure and processing of the coated photographic material.

i. Strips of the material were exposed through a grey wedge and processed in a colour developer of the formula given below for 2 minutes at 38° C. followed by a bleach fix at 38° C. After washing the strip was immersed in a solution of $FeSO_4$ (M/50) for 30 seconds, and then washed again in running water. The dye image, which was blue after bleachfixing, changed to a brownish black as shown in the accompanying graphs A and B in FIGS. 1 and 2.

EXAMPLE 1(1)

A strip of material containing a dye image prepared as in this Example, was irradiated in a Xeontest fade testing machine for 72 hours, with a strip of material prepared similarly but without treatment in a $FeSO_4$ solution as a control. The strip which had been treated with $FeSO_4$ retained 99% of its Dmax whereas the control only retained 51%.

The colour developer bath contains:

1,3-Diamino-3-propanol-tetra-acetic acid 2,4 g
Ethylene glycol 21.3 ml
Benzyl alcohol 15.2
Potassium carbonate 30 g
Potassium sulphite 4,3 g
Potassium bromide 0.6 g
Hydroxylamine sulphate 5.84 g
5.64 g of the compound (developer) of the formula

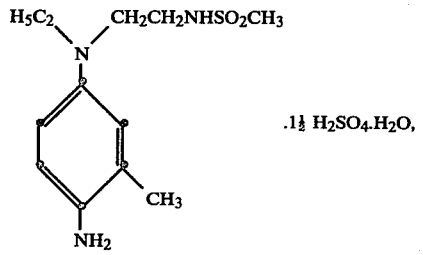

Water to give 1 liter; pH 10.25

The bleach fix (blix) bath contains:

123 ml 80% ammonium thiosulphate solution
13 g sodium metabisulphite
106 ml $FeNH_4$ ethylenediamine tetra-acetic acid. (1.7–1.8 molar)
pH 6.4 (approx.)

ii. Strips of the same material, similarly exposed and developed, were bleach-fixed in a ferric ammonium E.D.T.A. bath with a slight excess of ferric ion over E.D.T.A. such that the free ferric concentration was $10^{-2}$ molar. The strips were then washed as usual.

The dye image was a brownish black.

Figure 3C:
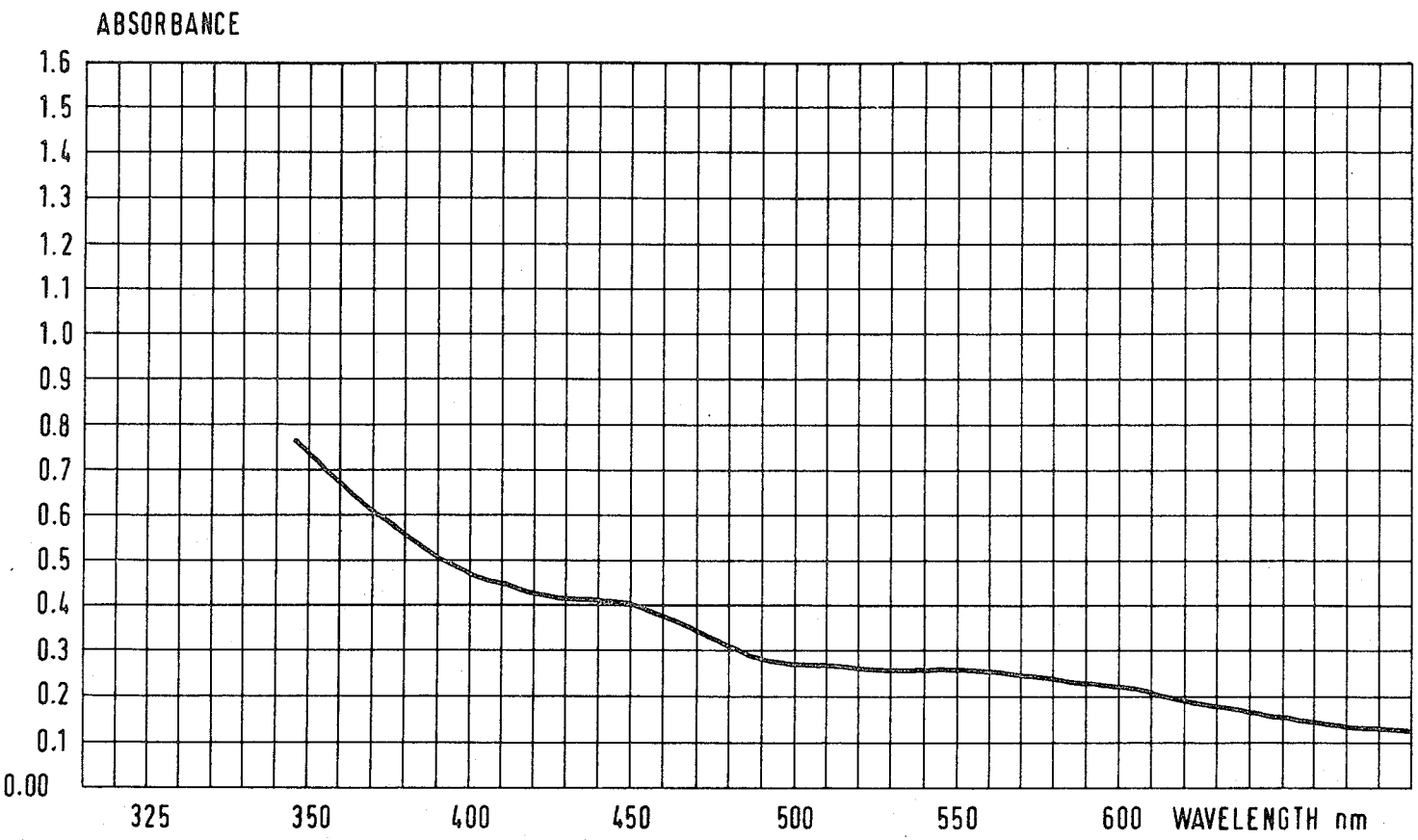
Figure 4:
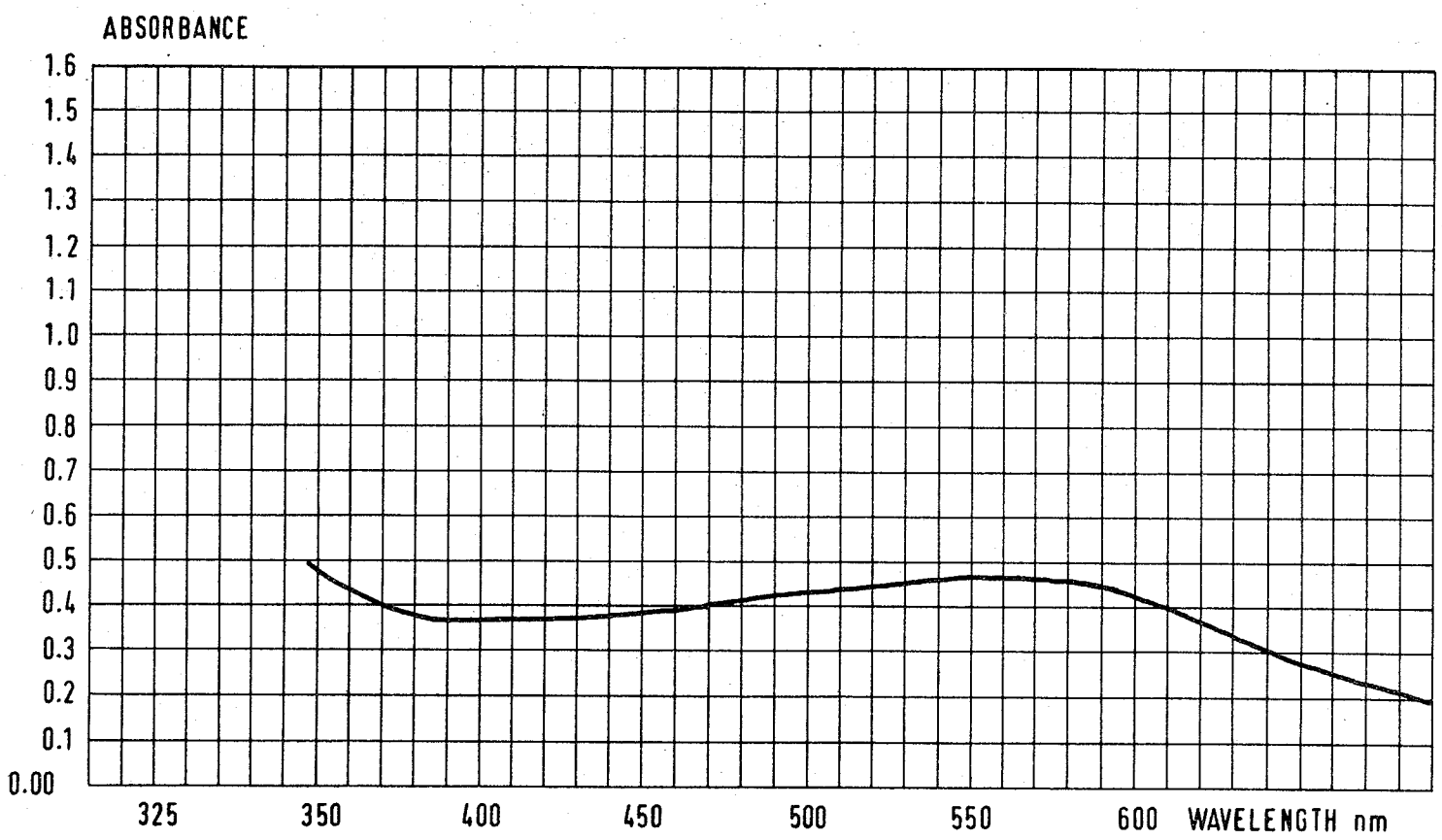
Figure 5E:
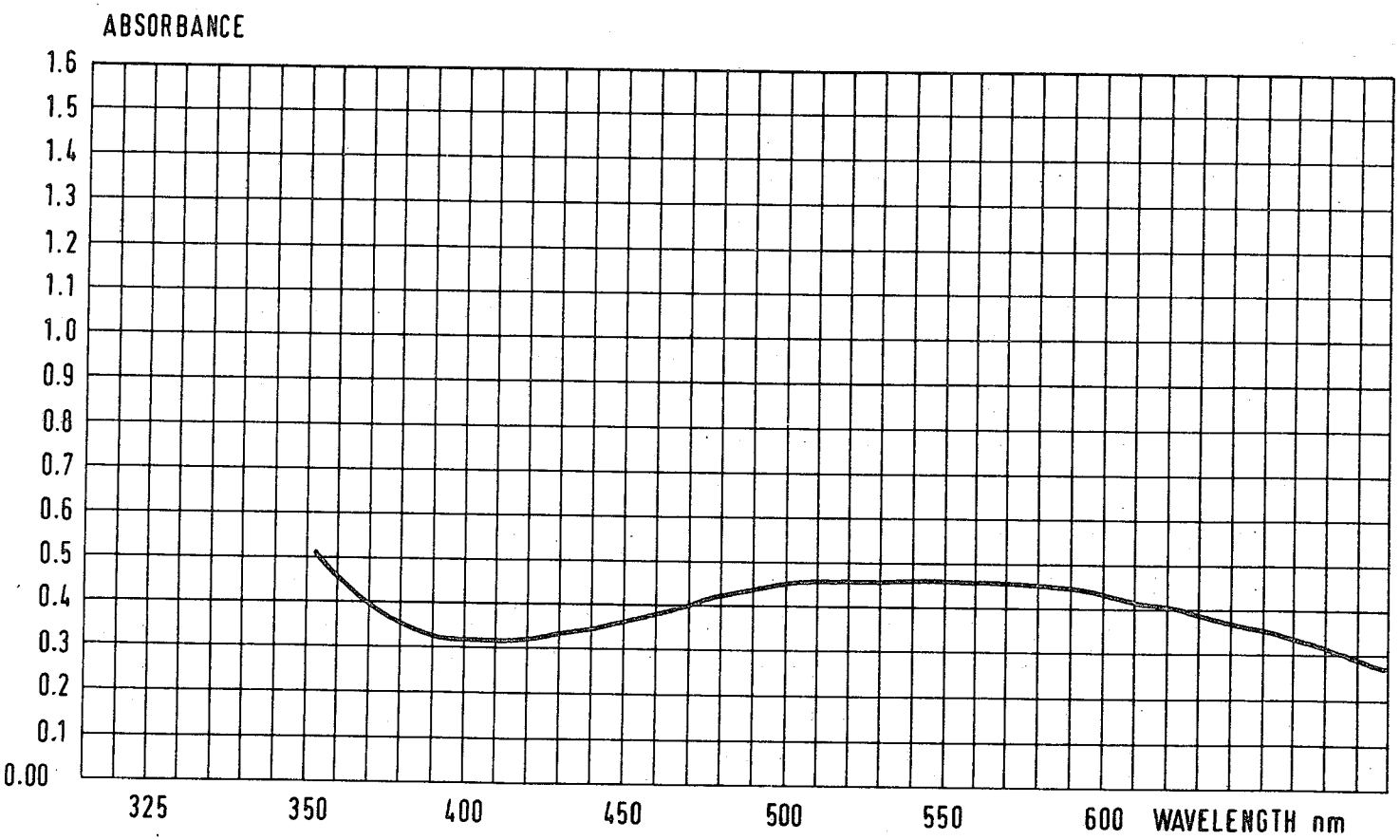

III. Procedure (i) was followed except that the bath used after the bleach fix contained, instead of $FeSO_4$, $TiCl_3$ solution (M/50). Strip emerged almost colourless, but regenerated to magenta dye.

iv. As (i) but bath after blix contained M/50 V(O)-$SO_4$ solution. Strip emerged black as shown on the accompanying graph C in FIG. 3.

v. As (i) but bath after blix contained 0.5 M $CrCl_3$ solution. In this case strip emerged blue, but turned to magenta on keeping.

vi. As (i) but bath after blix contained M/10 $MnCl_2$. Strip emerged purplish black as shown on the accompanying graph D in FIG. 4.

vii. As (i) but bath after blix contained M/10 $CoCl_2$. Strip emerged purplish black.

viii. As (i) but bath after blix contained M/10 $NiCl_2$. Strip emerged purplish black.

ix. As (i) but bath after blix contained M/10 $CuSO_4$. Strip emerged purplish black as shown on the accompanying graph E in FIG. 5.

x. As (i) but bath after blix contained M/10 $ZnSO_4$. Strip emerged purplish black.

xi. As (i) but bath after blix contained M/10 $DcSO_4$. Strip emerged purplish black.

xii. A strip of the same material as in (i) was exposed and developed as in (i). Then it was immersed in a bath of M/10 $V(O)SO_4$ solution for 60 seconds. It was then bleach-fixed for the usual time. The black dye image was retained through the bleach fix.

EXAMPLE II

Strips of photographic silver halide material coated on paper photographic base were prepared as in Example I except that 10 g of the coupler of the formula

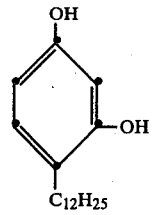

(8)

were used.

The material was exposed and processed as in Example I. It produced a bluish image, initially, which was changed to a blackish brown image after treatment with the $FeSO_4$ solution (M/50).

EXAMPLE III

A dispersion of a colour coupler was prepared as in Example I except that 10 g of a coupler of the formula

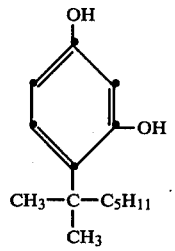

(9)

were used.

This colour coupler dispersion was added to a silver iodobromide emulsion containing 8.8% iodide (medium crystal size 0.8μ) and coated on a cellulose triacetate base. Strips of the coated material were exposed through a grey wedge and developed in a colour developing solution of the following formula:

Compound of the formula

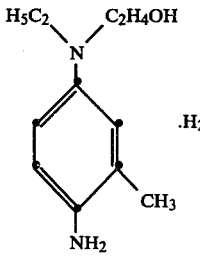

$.H_2SO_4$ 45.0 g

Hydroxylamine sulphate 20 g
Potassium sulphite 10 g
Potassium carbonate 350 g
Potassium bromide 15 g
Diethylene-diamine-penta-acetic acid 20 g
Water to give 2.5 l for 5 minutes at 38° C. They were then bleach-fixed for 5 minutes at 38° C. in the bleach-fix bath of the same formula as used in Example I. After water washing the dye image was found to be a bluish colour. The image was then treated by immersing the strip in a solution of M/100 $FeCl_3$ for 30 seconds to yield a brownish black image.

EXAMPLE IV

Strips of photographic material on cellulose triacetate base were prepared as in Example III except that 10 g of the coupler of the formula

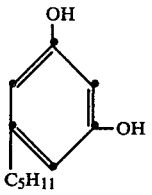

(10)

were used.

The strips were exposed and processed as in Example III as far as the washing stage. A magenta colour image was obtained in the photographic material.

The image was then treated by immersing the strips for 30 seconds in a solution of M/20 $V(O)SO_4$: The image then changed to a greyish black.

EXAMPLE V

One of the strips of photographic material as prepared for use in Example I was exposed and colour developed as in Example I. The material was then fixed using an ammonium thiosulphate solution and washed. This treatment left a black silver image reinforced by a bluish dye image. This image was then treated by immersing the strip for 30 seconds in a solution of M/50 $FeSO_4$. A black silver image reinforced by a brownish black dye image was obtained.

EXAMPLE VI

One of the strips of photographic material as prepared for use in Example I was exposed, colour developed and bleach-fixed as in Example I. A bluish image was obtained as in Example I. After the print had dried selected areas of the image were brought into contact with a solution of M/100 $FeSO_4$. At once this altered those areas of the image to a brownish black colour, thus resulting in a two-colour print.

We claim:

1. A method of treating a dye image in photographic material which dye image has been formed by the colour coupling reaction of a primary aromatic amine colour developing agent with a phenolic colour coupler of the formula

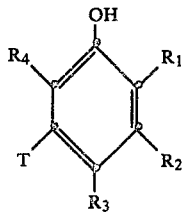

(1)

where T is —OH, —$NH_2$ or —$NHR_5$ where $R_5$ is alkyl or aryl, one of $R_1$ and $R_3$ is the coupling position and if it is the coupling position the substituent group is hydrogen or halogen, a nitrogen-linked heterocycle or —$SR_6$ where $R_6$ is optionally substituted alkyl having 1 to 20 carbon atoms or optionally substituted aryl or an optionally substituted heterocycle, the other of $R_1$ and $R_3$ and $R_2$ and $R_4$ are each hydrogen or halogen or optionally substituted organic groups, or one of $R_1$ and $R_2$ together or $R_2$ and $R_3$ together may represent the atoms necessary to complete an optionally substituted benzannelated ring, which treatment method comprises treating the dye image with an aqueous solution which comprises a salt of a metal selected from the group consisting of manganese, iron, nickel, cobalt, copper, zinc, cadmium, lead, aluminium, vanadium, chromium or titanium transition (b-sub group) metal, or a metal of the third or fourth main group of the periodic table of the elements, the concentration of the metal ion in the aqueous solution being at least $10^{-4}$M.

2. A method according to claim 1, wherein the colour coupler has the formula

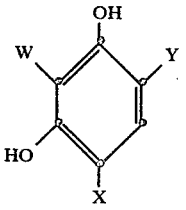

(2)

wherein

W is hydrogen, n-alkyl having from 1 to 5 carbon atoms, —$NHCOR^1$, or —$COR^1$ wherein $R^1$ is alkyl having 1 to 12 carbon atoms or alkenyl having 2 to 12 carbon atoms, cycloalkyl having 3 to 8 carbon atoms, aryl having 7 to 13 carbon atoms optionally substituted by one or two alkyl groups each having 1 to 4 carbon atoms, or halogen;

X is a substituent in the coupling position and is a leaving group selected from hydrogen, chlorine, bromine, a group of formula —$SR^{11}$ wherein $R^{11}$ is alkyl having 1 to 20 carbon atoms, aryl having 6 to 10 carbon atoms optionally substituted by one or two alkyl groups each having 1 to 4 carbon atoms, or a heterocyclic group, or X is a nitrogen-containing heterocyclic residue attached at a ring nitrogen atom;

Y independently is hydrogen or a group having the formula

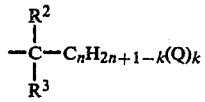

wherein Q is selected from the residues:

(a) —$COOR^4$ or —$CONR^4R^5$ wherein $R^4$ is hydrogen, alkyl having 1 to 20 carbon atoms, optionally interrupted by 1 or more oxygen atoms, alkenyl having 3 to 20 carbon atoms, cycloalkyl having 3 to 12 carbon atoms, aralkyl having 7 to 13 carbon atoms or optionally substituted aryl having 6 to 10 carbon atoms and $R^5$ is hydrogen or alkyl having 1 to 20 carbon atoms, or $R^4$ and $R^5$, together with the nitrogen atom to which they are each bonded, may form a 5- or 6-membered heterocyclic ring optionally substituted by alkyl having 1 to 4 carbon atoms, preferably a pyrrolidine, piperidine or morpholine ring;

(b) OM wherein M is $R^5$ or —$COR^6$ wherein $R^5$ is as defined above and $R^6$ is hydrogen, alkyl having 1 to 20 carbon atoms, alkenyl having 3 to 20 carbon atoms, cycloalkyl having 3 to 12 carbon atoms, aralkyl having 7 to 13 carbon atoms or optionally substituted aryl having 6 to 10 carbon atoms;

(c) —$NR^7R^8$ wherein $R^7$ is hydrogen or alkyl having 1 to 4 carbon atoms and $R^8$ is hydrogen, alkyl having 1 to 4 carbon atoms or acyl of the formula —$COR^4$ wherein $R^4$ is as defined above or $R^7$ and $R^8$, together with the nitrogen atom to which they are each bonded, form a 5- or 6-membered heterocyclic ring optionally substituted by alkyl having 1 to 4 carbon atoms preferably a pyrrolidine, piperidine, morpholine or 3,5-dimethylmorpholine ring;

(d) —$P(O)(OR^9)(O)_xR^{10}$ wherein x is 0 or 1, $R^9$ is hydrogen or alkyl having 1 to 20 carbon atoms, $R^{10}$ is hydrogen or alkyl having 1 to 20 carbon atoms if x is 1, and $R^{10}$ is alkyl having 1 to 5 carbon atoms if x is 0, or $R^9$ and $R^{10}$ may be linked together to form an alkylene chain having 2 or 3 carbon atoms optionally substituted by one or more alkyl groups each having 1 to 20 carbon atoms;

(e) —$SO_2T$ wherein T is —OH or —$NR^4R^5$ wherein $R^4$ and $R^5$ are as defined above or (f) —CN;

n is an integer from 1 to 20; k is 1 or 2; $R^2$ and $R^3$ independently are alkyl having 1 to 5 carbon atoms, and, when Q is —$CO_2R^4$, either $R^2$ or $R^3$ is optionally substituted by one or two —$CO_2R^4$ groups, or at least one of $R_2$ and $R_3$ is so linked to the residue —$C_nH_{2n+1-k}$ that there is formed a cycloalkylene residue having 5 to 12 carbon atoms substituted by —$(CO_2R^4)_k$ in which the groups $R^4$ are the same or different and wherein $R^4$ and k are as defined above; or salts thereof with acids or bases.

3. A method according to claim 2, wherein W is hydrogen, n-alkyl having 1 to 5 carbon atoms, cyclopentyl, cyclohexyl, phenyl optionally substituted by one or two alky groups each having 1 to 4 carbon atoms or W is halogen, X is hydrogen, chlorine, bromine, —$SR^{11}$ where $R^{11}$ is alkyl having 1 to 10 carbon atoms, phenyl optionally substituted by one or two alkyl groups each having 1 to 4 carbon atoms or a tetrazolyl ring optionally substituted by alkyl having 1 to 4 carbon atoms or phenyl, Y is a group of the formula

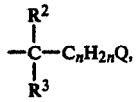

where Q is —COOR$^4$ or —CONR$^4$R$^5$ where R$^4$ is hydrogen, alkyl having 1 to 12 carbon atoms optionally interrupted by 1 or 2 oxygen atoms, benzyl or phenyl and R$^5$ is hydrogen or alkyl having 1 to 10 carbon atoms, or R$^4$ and R$^5$, together with the nitrogen atom to which they are bonded form a morpholinyl or a piperidinyl radical, or Q is —OM, where M is hydrogen or alkyl having 1 to 5 carbon atoms, or M is —COR$^6$ where R$^6$ is hydrogen, alkyl having 1 to 10 carbon atoms, cyclohexyl, phenyl or benzyl, or Q is —NR$^7$R$^8$ where R$^7$ is hydrogen or alkyl having 1 to 4 carbon atoms and R$^8$ is —COR$_4$ where R$_4$ is as defined above, or Q is —P(O)(OR$^9$)$_2$ where R$^9$ is alkyl having 1 to 10 carbon atoms, or Q is —SO$_2$T where T is hydroxy or —NR$^4$R$^5$ where R$^4$ R$^5$ are as defined above, R$^2$ and R$^3$ are alkyl having 1 to 5 carbon atoms or at least one of R$^2$ and R$^3$ is so linked to the residue —C$_n$H$_{2n}$— that there is formed a cycloalkyl group having 5 to 8 carbon atoms optionally substituted by a group —COOR$^4$ where R$^4$ is as defined above, and n is an integer from 1 to 20.

4. A method according to claim 3, wherein W is hydrogen, methyl, chlorine or bromine, X is hydrogen, chlorine, bromine or a group of the formula

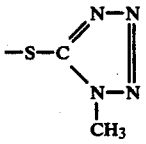

and Y is a group of the formula

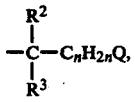

wherein

Q is —COOR$^4$ or —CONR$^4$R$^5$, where R$^4$ is hydrogen or alkyl having 1 to 12 carbon atoms and R$^5$ is alkyl having 5 to 10 carbon atoms or phenyl optionally substituted by alkyl having 1 to 4 carbon atoms, or Q is —OM, wher M is hydrogen or —COR$_6$ where R$_6$ is alkyl having 1 to 5 carbon atoms, or Q is —NHR$_8$ where R$_8$ is —COR$_6$ where R$_6$ is as just defined or Q is —P(O)(OR$_9$)$_2$, where R$_9$ is alkyl having 1 to 5 carbon atoms, or Q is —SO$_2$NR$^5$R$^6$ where R$^6$ is as defined above, and R$_2$ and R$_3$ are alkyl having 1 to 5 carbon atoms or R$_2$ forms together with the residue —C$_n$H$_{2n}$— a cyclohexyl group substituted by —COOR$^4$ where R$^4$ is as defined above, and n is an integer from 1 to 10.

5. A method according to claim 1, wherein the colour coupler has the formula

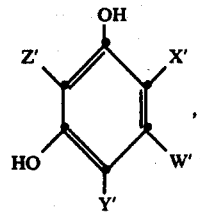

(4)

where each of W', Y' and Z' is hydrogen, chlorine or bromine, a nitrogen-linked heterocycle, —SR$_1$' where R$_1$' is optionally substituted alkyl having 1 to 20 carbon atoms, optionally substituted aryl or an optionally substituted heterocycle or W', Y' or Z' is —NHCOR$_2$', where R$_2$' is alkyl or —R$_3$' where R$_3$' is optionally substituted primary or secondary alkyl having 1 to 20 carbon atoms of the formula

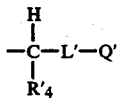

where

L' is an alkylene linking group —(C$_m$H$_{2m}$)— where m is 1 to 20 or a chemical bond, R$_4$' is hydrogen or alkyl having 1 to 20 carbon atoms, or R$_4$' together with L' form a saturated 5- or 6-membered carbocyclic ring linking group, and Q' is hydrogen or is a group selected from —OCOR$_5$' where R$_5$' is alkyl having 1 to 20 carbon atoms, —CO$_2$R$_5$' where R$_5$' is as just defined, —CONHR$_6$' where R$_6$' is alkyl having 1 to 20 carbon atoms or is optionally substituted aryl, —OR$_6$', where R$_6$' is as just defined, —NHCOR$_6$' where R$_6$' is as defined above, —SO$_3$M' where M' is hydrogen or a cation, —P(O)(OR$_5$')$_2$ where R$_5$' is as defined above or —NR$_7$'R$_8$' where each of R$_7$' and R$_8$' are hydrogen or optionally substituted alkyl or aryl, or R$_3$' is unsubstituted tertiary alkyl wherein the tertiary atom is adjacent to the benzene ring or a secondary or tertiary cycloalkyl having 3 to 20 carbon atoms or R$_3$' is aralkyl, having 7 to 20 carbon atoms or Z alone is —CO—R$_1$' where R$_1$' is as just defined but at least one of W', Y' and Z' must be —R$_3$', and X' which is the coupling position is hydrogen, chlorine or bromine, a nitrogen-linked heterocycle or —SR$_1$'.

6. A method according to claim 5 wherein W', Y' and Z' are hydrogen, chlorine, bromine, a radical of the formula

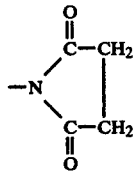

wherein the hydrogen atoms are optionally replaced by alkyl having 1 to 4 carbon atoms or phenyl, or W', Y' and Z' are —SR$_1$', wherein R$_1$' is alkyl having 1 to 20 carbon atoms, optionally substituted by alkoxy having 1 to 10 carbon atoms, carbalkoxy having 2 to 5 carbon atoms, phenyl or halogen, or $R_1'$ is phenyl optionally substituted by alkoxy having 1 to 10 carbon atoms, carbalkoxy having 2 to 5 carbon atoms, phenyl or halogen, or $R_1'$ is a radical of the formula

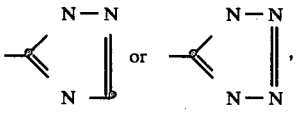

wherein the nitrogen atom adjacent to the carbon atom which provides the linkage to the resorcinol nucleus is optionally substituted by alkyl having 1 to 4 carbon atoms or phenyl, or W', Y' or Z' is a group —NH-$COR_2'$, where $R_2'$ is alkyl having 1 to 20 carbon atoms or phenyl, optionally substituted by alkoxy having 1 to 10 carbon atoms, carbalkoxy having 2 to 5 carbon atoms, phenyl or halogen or W', Y' or Z' is a group —$R_3'$ where —$R_3'$ is primary or secondary alkyl having from 1 to 15 carbon atoms of the formula

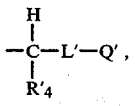

where

L' is an alkylene linking group of the formula —($C_mH_{2-m}$)—, m being an integer of from 1 to 15 or a chemical bond $R_4'$ is hydrogen, alkyl having 1 to 10 carbon atoms or forms together with L' a cyclopentyl or cyclohexyl ring which is optionally substituted by phenyl, methyl, ethyl, n-propyl, i-propyl, n-butyl or t-butyl, Q' is hydrogen or —$CO_2R_5'$ or —$OCOR_5'$ where $R_5'$ is alkyl having 1 to 20 carbon atoms; —$OR_6'$, —$CONHR_6'$ or —$NHCOR_6'$ where $R_6'$ is alkyl having 1 to 10 carbon atoms or phenyl optionally substituted by alkyl groups each having 1 to 10 carbon atoms, —$SO_3M'$ where M is hydrogen, ammonium or an alkali metal; —$P(O)(OR_6')_2$, where $R_6'$ is as defined above; or —$NR_7'R_8'$ where $R_7'$ and $R_8'$ are hydrogen, alkyl having 1 to 5 carbon atoms or phenyl; or $R_3'$ is unsubstituted tertiary alkyl having 3 to 10 carbon atoms or $R_3'$ is secondary or tertiary cycloalkyl having 3 to 10 carbon atoms, or $R_3'$ is aralkyl having 7 to 20 carbon atoms, or Z' alone is —$COR_1'$ where $R_1'$ is as defined above but at least one of W', Y' and Z' must be —$R_3'$, X' is hydrogen, chlorine, a radical of the formula

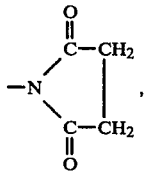

wherein the hydrogen atoms are optionally replaced by alkyl having 1 to 4 carbon atoms or phenyl, or X' is —$SR_1'$ where $R_1'$ is as defined above.

7. A process according to claim 6 wherein W', Y' and Z' are hydrogen, chlorine, bromine, a radical of the formula

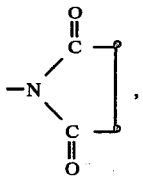

—$SR_1'$ wherein $R_1'$ is alkyl having 1 to 10 carbon atoms or phenyl or a radical of the formula

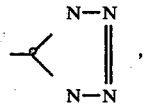

wherein the nitrogen atom adjacent to the carbon atom which provides the linkage to the resorcinol nucleus is optionally substituted by phenyl or methyl, or W', Y' or Z' is —$NHCOR_2'$ where $R_2'$ is alkyl having 1 to 10 carbon atoms or phenyl or W', Y' or Z' is a group —$R_3'$ where —$R_3'$ is primary or secondary alkyl having 1 to 15 carbon atoms of the formula

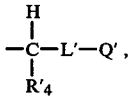

where L' is as defined in claim 6, $R_4'$ is hydrogen, alkyl having 1 to 5 carbon atoms or forms together with L' a cyclopentyl or cyclohexyl ring optionally substituted by phenyl, methyl or t-butyl, Q' is hydrogen, —$CO_2R_5'$ or —$OCOR_5'$ where $R_5'$ is alkyl having 6 to 12 carbon atoms; —$OR_6'$, —$CONHR_6'$ or —$NHCOR_6'$ where $R_6'$ is alkyl having 1 to 5 carbon atoms or phenyl; —$SO_3M'$ where M' is hydrogen oran alkali metal; —$P(O)(OR_6')_2$, where $R_6'$ is as defined above; and —$NR_7'R_8'$ where $R_7'$ and $R_8'$ are hydrogen, alkyl having 1 to 5 carbon atoms or phenyl; or $R_3'$ is unsubstituted tertiary alkyl having 5 to 10 carbon atoms or secondary or tertiary cycloalkyl having 5 to 10 carbon atoms, or $R_3'$ is aralkyl having 7 to 15 carbon atoms, or Z' alone is —$COR_1'$ where $R_1'$ is as defined above but at least one of W', Y' and Z' must be —$R_3'$, X' is hydrogen, chlorine, bromine or —$SR_1'$ where $R_1'$ is as defined above.

8. A process according to claim 7 wherein W', Y' and Z' are hydrogen, chlorine, bromine, or W', Y' or Z' is —$NHCOR_2'$ where $R_2'$ is methyl, phenyl, or a group —$R_3'$ where —$R_3'$ is primary or secondary alkyl having 1 to 15 carbon atoms of the formula

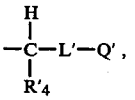

where L is as defined in claim 7, $R_4$ is hydrogen, methyl or forms together with L' a cyclohexyl ring optionally substituted by t-butyl, Q' is hydrogen, —$CO_2R_5'$ where $R_5'$ is alkyl having 5 to 15 carbon atoms, —$OR_6'$ where $R_6'$ is phenyl optionally substituted by alkyl groups each having 4 to 8 carbon atoms, or amino or —NH-$COCH_3$ or —$NHCOC_6H_5$; or $R_3'$ is unsubstituted tertiary alkyl having 5 to 8 carbon atoms or $R_3'$ is secondary or tertiary cycloalkyl having 5 to 10 carbon atoms or aralkyl having 7 to 15 carbon atoms, at least one of W', Y' and Z' must be —$R_3$', and Y' is hydrogen, chlorine bromine or a radical of the formula

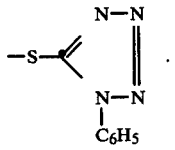

9. A method according to claim 1 wherein the metal salt used is a salt of iron (II) or (III), copper (II) or vanadium (IV).

10. A method according to claim 1 wherein the concentration of metal salt is M/50.

11. A method according to claim 1 wherein the metal ion is in solution in the water wash bath or in a separate aqueous bath which is employed between treatment steps in the processing of the photographic material.

12. A method according to claim 1, wherein the metal ion is in an aqueous bleach or bleach-fix bath.

13. A method according to claim 1 wherein a dye image only is present in the photographic material before this dye image is treated with the solution of the metal salt.

14. A method according to claim 1 wherein a silver image and a dye image are both present in the photographic material before the dye image is treated with the solution of the metal salt.

15. The photographic dye image obtained by the method according to claim 1.

* * * * *

UNITED STATES PATENT AND TRADEMARK OFFICE

CERTIFICATE OF CORRECTION

PATENT NO. : 4,436,798

DATED : March 13, 1984

INVENTOR(S) : Christopher D. Shennan et al

It is certified that error appears in the above-identified patent and that said Letters Patent is hereby corrected as shown below:

| | |
|---|---|
| Col. 19, lines 34, 35, and 36 | Delete "transition (b-sub group) metal, or a metal of the third or fourth main group of the periodic table of the elements," |

Signed and Sealed this

*Eighteenth* Day of *December 1984*

[SEAL]

*Attest:*

GERALD J. MOSSINGHOFF

*Attesting Officer*

*Commissioner of Patents and Trademarks*